US009241569B2

(12) United States Patent
Wang et al.

(10) Patent No.: US 9,241,569 B2
(45) Date of Patent: Jan. 26, 2016

(54) FURNITURE WITH INTERCHANGEABLE ARRANGEMENT

(71) Applicants: George Wang, City of Industry, CA (US); Rocky Yang, City of Industry, CA (US)

(72) Inventors: George Wang, City of Industry, CA (US); Rocky Yang, City of Industry, CA (US)

(73) Assignee: Furniture of America, Inc., City of Industry, CA (US)

( * ) Notice: Subject to any disclaimer, the term of this patent is extended or adjusted under 35 U.S.C. 154(b) by 0 days.

(21) Appl. No.: 14/102,514

(22) Filed: Dec. 11, 2013

(65) Prior Publication Data

US 2015/0157126 A1 Jun. 11, 2015

(51) Int. Cl.

| | |
|---|---|
| ***A47B 13/00*** | (2006.01) |
| ***A47B 95/04*** | (2006.01) |
| ***A47C 7/62*** | (2006.01) |
| ***A47C 7/40*** | (2006.01) |
| ***A47B 85/04*** | (2006.01) |

(52) U.S. Cl.

CPC ..... *A47B 95/04* (2013.01); *A47B 85/04* (2013.01); *A47C 7/40* (2013.01); *A47C 7/62* (2013.01)

(58) Field of Classification Search

CPC ..... A47C 4/02; A47C 4/03; A47B 3/06; A47B 13/02

USPC ..... 108/161, 153.1, 150, 19, 11, 158.12, 108/157.18, 50.02, 157.14; 248/188.7; 297/440.1

See application file for complete search history.

(56) References Cited

U.S. PATENT DOCUMENTS

| | | | | | |
|---|---|---|---|---|---|
| 1,639,085 | A * | 8/1927 | Fohey | 297/188.04 |
| 3,697,363 | A * | 10/1972 | martinez | 428/67 |
| 4,448,463 | A * | 5/1984 | Amos | 312/111 |
| 4,929,021 | A * | 5/1990 | Kaye | 297/188.09 |
| 5,448,844 | A * | 9/1995 | Miller et al. | 40/611.06 |
| 5,634,411 | A * | 6/1997 | Chasan | 108/153.1 |
| 6,053,585 | A * | 4/2000 | Osen | 312/204 |
| 6,182,307 | B1 * | 2/2001 | Rutrick | 5/53.1 |
| 6,543,071 | B1 * | 4/2003 | Lenner | 5/280 |
| 6,766,748 | B2 * | 7/2004 | Insalaco et al. | 108/50.02 |
| 7,722,123 | B2 * | 5/2010 | Holland | 297/440.1 |
| 2003/0145377 | A1 * | 8/2003 | Paul | 5/53.1 |
| 2013/0147244 | A1 * | 6/2013 | Carter, III | 297/217.6 |

* cited by examiner

*Primary Examiner* — Jose V Chen

(74) *Attorney, Agent, or Firm* — Raymond Y. Chan; David and Raymond Patent Firm

(57) ABSTRACT

Furniture includes a utilizing unit, a main supporting frame, and an interchangeable arrangement which includes a plurality of reusable decorative elements interchangeably and selectively coupled at the main supporting frame to change an overall ornamental design of the furniture without disassembling the main supporting frame.

18 Claims, 7 Drawing Sheets

FURNITURE WITH INTERCHANGEABLE ARRANGEMENT

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

1. Field of Invention

The present invention relates to furniture, and more particularly to furniture with interchangeable arrangement for altering the overall ornamental appearance of furniture without affecting the main structure thereof.

2. Description of Related Arts

Nowadays, people are highly aware of their living environment such that people devoted much enthusiasm for decorating their houses and offices. Furniture, such as table, desk, chair, and sofa, is essential item and is considered a form of decorative art. In addition to its original function, it can serve as a decorative purpose. Generally speaking, furniture is a durable and bulky item that when the furniture is placed in a particular area of a room, the furniture will not be moved or relocated. Therefore, the furniture must be seriously selected to match with the interior design of the room. In the existing market, there are different designs of furniture to match with personal preference and interior room design. In other words, people usually bought furniture which matches with the color or design as the interior environment of their rooms. In addition, furniture usually is configured with a one-piece structure to enhance the rigidity of the furniture and to provide a particular unique design for decoration. Sometimes, the furniture store provides pre-design service that the customer is able to design the furniture before the final product is made. Therefore, the customer is able to choose different colors or patterns for the furniture. For example the customer is able to choose a particular color for the tabletop and a crafting design for the table legs in order to form a table. However, the pre-designable furniture will keep its overall ornamental appearance after it is made.

When people remodel their houses or offices, the interior design thereof will be totally changed. In other words, the existing furniture will not match with the new design. It is a waste to purchase new furniture when the original furniture is still in good condition. The easiest way to keep the original furniture for the new design is to re-paint the furniture. However, it is time consuming to sand and re-paint the original furniture.

Assembling furniture is introduced on the current market, wherein the assembling furniture comprises a plurality of detachable connectors for connecting different components together such that the user is able to detach and replace some of the components. For example, the detachable connectors are used for connecting the tabletop with the table legs, such that the user is able to replace the tabletop while the table legs are kept. However, the detachable connectors will weaken the rigidity of the furniture. The joints of the furniture via the detachable connectors will be loosen when the components of the furniture are repeatedly detached and re-attached. Meanwhile, the user may need lots of time to assemble all the components together, which is less efficiency and time-consuming.

Moreover, due to the components have large sizes, large spaces are required for storing different components of the furniture. Most importantly, the cost for buying different kinds of components is always expensive. For the people who are enthusiasm to decorating their living spaces and offices, the assembling furniture are high in cost and, large sizes, and time-consuming.

SUMMARY OF THE PRESENT INVENTION

A main object of the present invention is to provide a furniture comprising an interchangeable arrangement which can immediately change ornamental design of the furniture without affecting the main structure of the furniture.

Another object of the present invention is to provide the furniture, wherein the interchangeable arrangement comprises a plurality of decorative elements having different kinds of designs and patterns for providing different ornamental designs.

Another object of the present invention is to provide the furniture, wherein the decorative element can be detachably coupled with the main supporting frame of the furniture without dissembling the main supporting frame. In other words, the decorative element can be detachably coupled with the main supporting frame in a tool-less manner.

Another object of the present invention is to provide the furniture, wherein two sliding slots are formed at each pair of supporting members to enable the decorative element to slidably couple between each pair of the supporting members.

Another object of the present invention is to provide the furniture with interchangeable arrangement which does not require to alter the original structure design of the furniture, so as to reduce the cost and save the time for changing the ornament design of the furniture.

Another object of the present invention is to provide the furniture with interchangeable arrangement, wherein no expensive or complicated structure is required to employ in the present invention in order to achieve the above mentioned objects. Therefore, the present invention successfully provides an economic and efficient solution for providing an interchangeable arrangement for the furniture to change ornamental design of the furniture without affecting the main structure of the furniture.

Additional advantages and features of the invention will become apparent from the description which follows, and may be realized by means of the instrumentalities and combinations particular point out in the appended claims.

Accordingly, in order to achieve the above objects, the present invention provides a furniture, comprising:

a utilizing unit;

a main supporting frame supporting the utilizing unit; and an interchangeable arrangement which comprises a plurality of decorative elements interchangeably and selectively coupled at the main supporting frame to change an overall ornament design of the furniture without disassembling the main supporting frame.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 1:
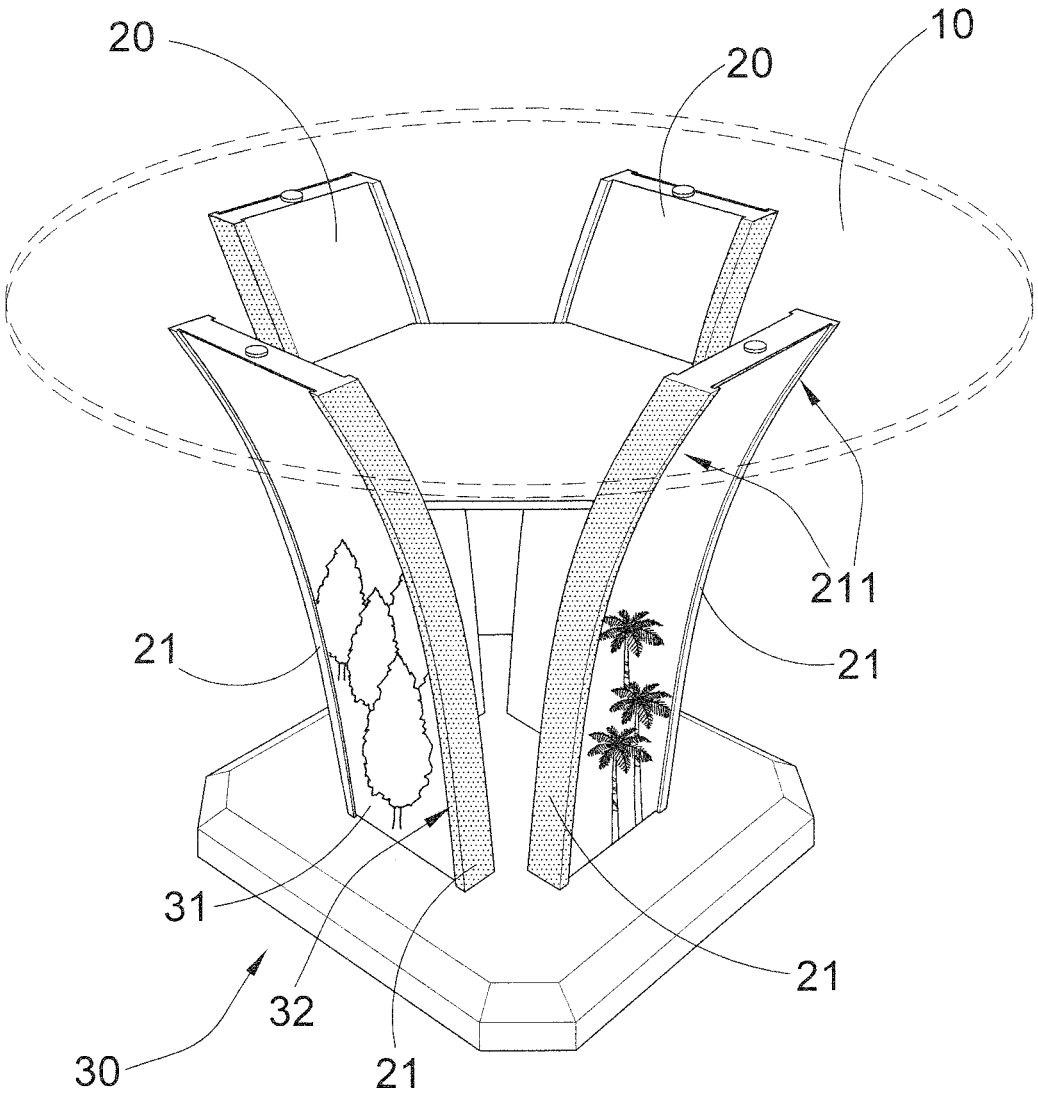
FIG. 1 is a perspective view of a furniture according to a first preferred embodiment of the present invention.
Figure 2:
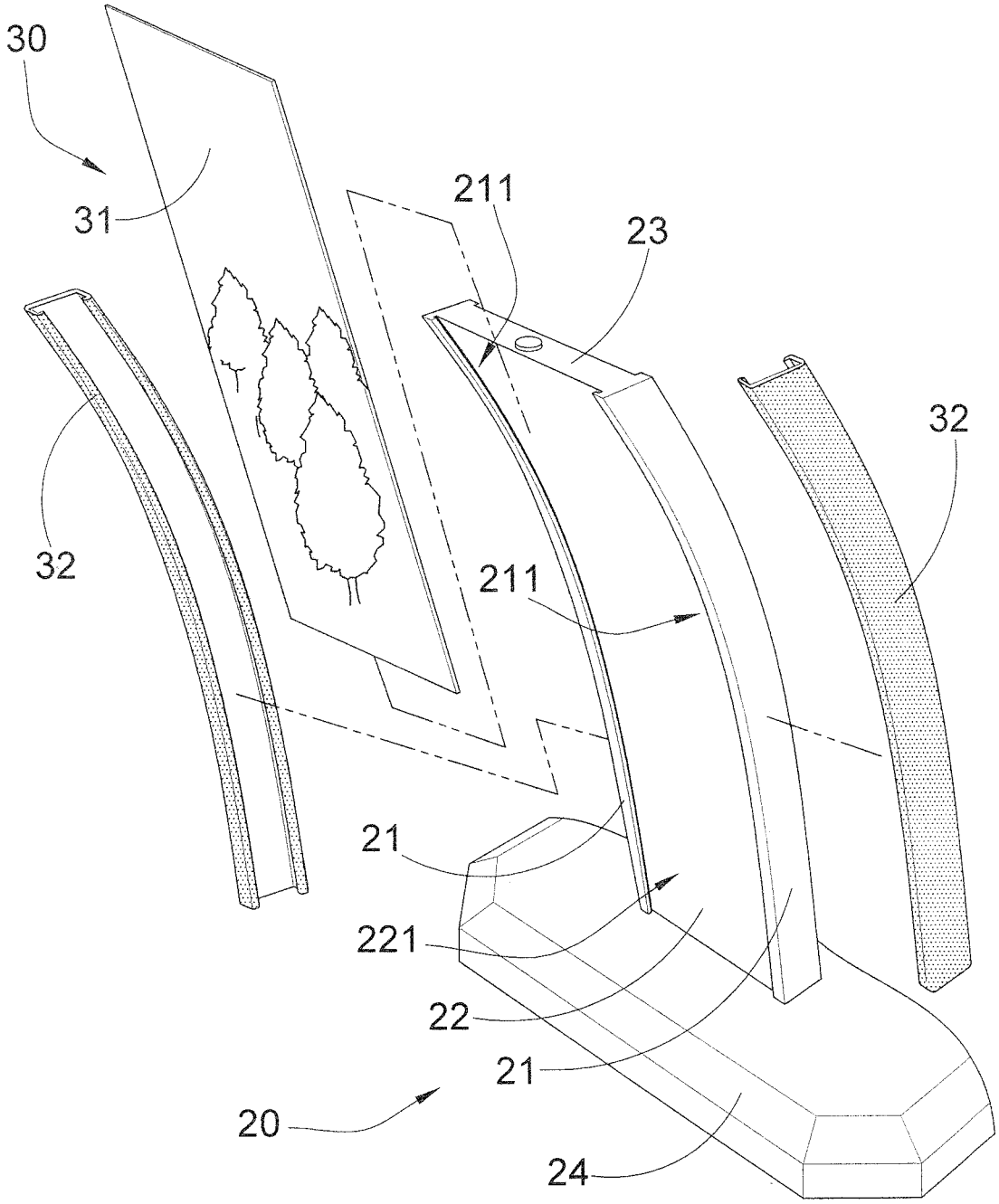
FIG. 2 is a perspective view of a main supporting frame incorporating with the interchangeable arrangement according to the above preferred embodiment of the present invention.

Referring to FIGS. 1 and 2 of the drawings, a furniture for immediately change the ornament design of the furniture according to a first preferred embodiment of the present invention is illustrated, wherein the furniture comprises a utilizing unit 10, a main supporting frame 20 supporting the utilizing unit, and a interchangeable arrangement 30 for providing various kinds of ornamental design for the furniture.

As shown in FIG. 1, the furniture is shown as a table, wherein the utilizing unit 10 is a tabletop and the main supporting frame 20 is a leg frame to support the tabletop. It should be appreciated that the furniture can be a chair, wherein the utilizing unit 10 is a sitting panel and the main supporting frame 20 is a leg frame to support the sitting panel. Or, the furniture can be a desk, wherein the utilizing unit 10 is a desktop and the main supporting frame 20 is a leg frame to support the desktop.

According to the preferred embodiment, the main supporting frame 20 comprises at least two supporting members 21 formed in pair to support the utilizing unit 10, and a plurality of supporting panels 22. Each of the supporting panels 22 is coupled between each pair of the supporting member 21 to define a decorative face 221 at the supporting panel 22. Accordingly, the two supporting members 21 in pair are symmetrical.

A thickness of each of the supporting panels 22 is smaller than a thickness of each of the supporting members. Therefore, when the supporting panel 22 is coupled between the two supporting members 21, the two supporting members 21 and the supporting panel 22 form a H-shaped cross sectional configuration. Accordingly, the supporting members 21 and the supporting panels 22 can be made of materials. For example, the supporting members 21 are made of wood and the supporting panels 22 are made of glass. Alternatively, the supporting members 21 and the supporting panels 22 can be made of materials, wherein the supporting members 21 and the supporting panels 22 are made of wood. Therefore, the supporting members 21 and the supporting panels 22 can be form in a one piece integrated structure.

Figure 3:
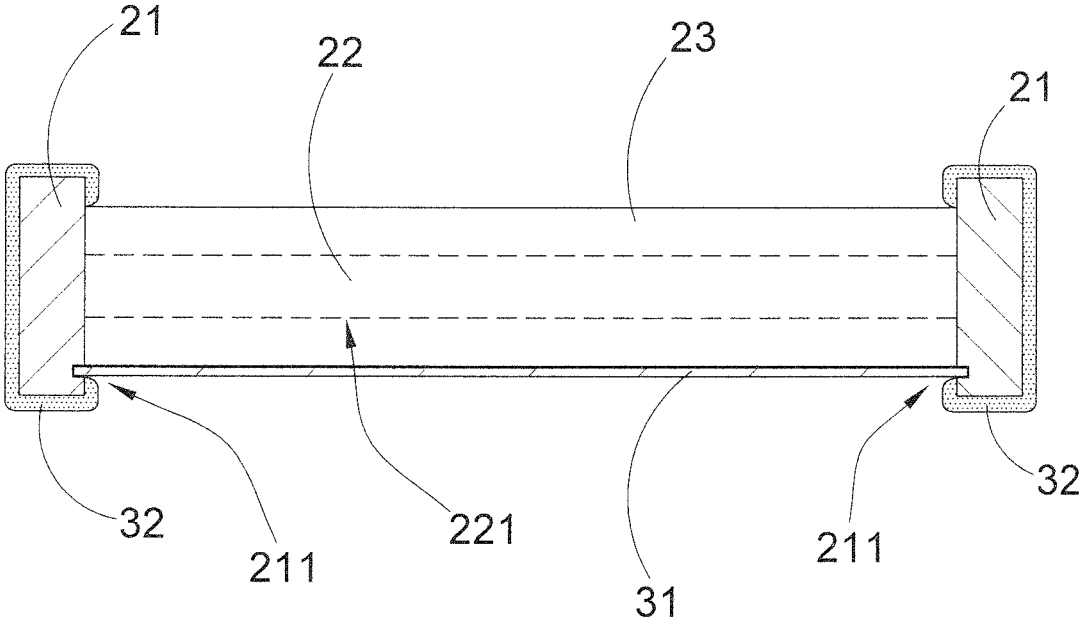
FIG. 3 a top view of the main supporting frame incorporating with the interchangeable arrangement according to the above preferred embodiment of the present invention.

The main supporting frame 20 further comprises a plurality of top supports 23, wherein each of the top supports 23 is extended between two top ends of the pair of the supporting members 21. A thickness of the top support 23 is larger than the thickness of the supporting panel 22 and is smaller than the thickness of the supporting member 21. In other words, the two supporting members 21 and the top support 23 also form a H-shaped cross sectional configuration as shown in FIG. 3. Preferably, the supporting members 21 and the top supports 23 are made of same material to enhance the rigidity of the main supporting frame 20 to support the utilizing unit 10.

The main supporting frame 20 further comprises a base 24, wherein the supporting members 21 are upwardly extended from the base 24.

As shown in FIG. 3, each pair of the supporting members 21 are parallel with each other and are extended in a curve configuration from the base 24 to the top support 23. In particular, each pair of the supporting members 21 are curved outwardly from the base 24 to the top support 23, such that the upper ends of the supporting members 21 form an enlarged supporting area to support the utilizing unit 10.

It is worth mentioning that the utilizing unit 10, i.e. the tabletop, can be configured in different shapes. When the utilizing unit 10 is formed in a circular shape, four pairs of supporting members 21 are provided in a coaxial manner, as shown in FIG. 1. When the utilizing unit 10 is formed in a rectangular shape, four pairs of supporting members 21 are provided in such a manner that two pairs of supporting members 21 are arranged to support at two longitudinal sides of the utilizing unit 10 respectively while another two pairs of supporting members 21 are arranged to support at two longitudinal sides of the utilizing unit 10 respectively.

Figure 4:
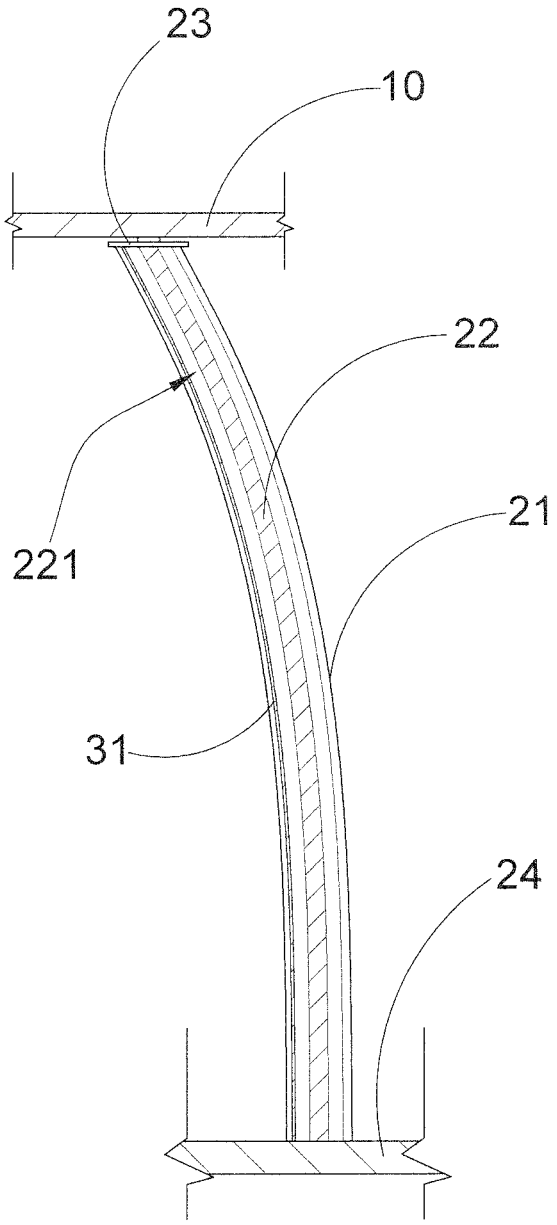
FIG. 4 is a sectional view of the main supporting frame incorporating with the interchangeable arrangement according to the above preferred embodiment of the present invention.

As shown in FIGS. 2 to 4, each pair of the supporting members 21 has two sliding slots 211 formed at inner sides thereof. Accordingly, the two sliding slots 211 of the supporting members 21 are facing toward each other. In other words, each sliding slot 211 is indently formed at the inner side of each of the supporting members 21. In particular, the sliding slots 211 are formed at the supporting members 21 in front of the supporting panels 22.

Each sliding slot 211 has a bottom opening formed at the bottom end of each of the supporting members 21 which is located at the base 24, and an upper opening formed at the upper end of each of the supporting members 21. The bottom opening of the sliding slot 211 is blocked by the base 24. Furthermore, the top opening of each of the sliding slots 211 is formed at the top end of the supporting member 21 at a position adjacent to the top support 23. In other words, the top opening of each of the sliding slots 211 will not be blocked by the top support 23. Each of the sliding slots 211 further has a side opening, wherein the side openings of the sliding slots 211 at the pair of supporting members 21 are facing toward each other.

According to the preferred embodiment, the interchangeable arrangement 30 comprises a plurality of reusable decorative elements 31 interchangeably and selectively coupled at the main supporting frame 20 to change an overall ornamental design of the furniture without disassembling the main supporting frame 20.

Each of the decorative elements 31 is detachably coupled between two of the supporting members 21 in pair to create a decorative effect for the main supporting frame 20. In particular, the decorative elements 31 are detachably overlapped at the decorative faces 221 of the supporting panels 22 respectively.

In order to detachably attach the decorative element 31 at the decorative face 221 of the supporting panel 22, each of the decorative elements 31 is slid at the sliding slots 221 to couple between the two supporting members 21 and to spacedly overlap on the decorative face 221 of the respective supporting panel 22. Accordingly, each of the decorative elements 31 is a decorative panel, wherein the decorative panel is a thin panel preferably made of durable and flexible material such as plastic or metal. Each decorative panel has its own design and/or decorative pattern, such that when the decorative panels are coupled to the main supporting frame 20, the overall ornamental design of the furniture will be changed. Therefore, two side edge portions of the decorative panel are slidably engaged with the sliding slots 211 to couple the decorative panel between the two supporting members 21. Since the decorative panel is made of flexible material, the decorative panel can be bent to match with a curvature of the supporting member 21 when the decorative panel is slidably engaged between the sliding slots 211.

Accordingly, the decorative element 31 is slid to engage between the supporting members 21 from the top openings of the sliding slots 211 toward the bottom openings thereof. Since the bottom opening of the sliding slot 211 is blocked by the base 24, the decorative element 31 is slid to engage with the sliding slots 211 from the top openings thereof and is blocked by the base 24. It is worth mentioning that the decorative element 31 is extended between the side openings of the sliding slots 211 at the pair of supporting members 21. Each of the decorative elements 31 is encircled within the two supporting members 21, the base 24, and the utilizing unit 10.

As shown in FIGS. 2 to 4, the interchangeable arrangement 30 further comprises a plurality of decorative sleeves 32 detachably enclosing the supporting members 21 respectively, wherein the sliding slots 211 are exposed when the supporting members 21 are received in the decorative sleeves 32 respectively.

Each of the decorative sleeves 32 forms a frame cover not only to decorate the supporting member 21 but also to protect the supporting member 21. Each of the decorative sleeves 32 is made of flexible material to fit the supporting member 21 thereat. Preferably, each of the decorative sleeves 32 has a C-shaped cross section, such that when the supporting member 21 is received in the decorative sleeve 32, the outer side, the front side, and the rear side of the supporting member 21 are covered by the decorative sleeve 32. Each of the decorative sleeves has its own design and/or decorative pattern which can mix and match with the decorative elements 31.

In order to change the overall ornamental design of the furniture, the user is able to remove the utilizing unit 10 from the main supporting frame 20. For an example of the table, the user is able to remove the tabletop from the leg frame. Therefore, the top openings of the sliding slots 211 are exposed and are able to be accessed. The user is able to select one of the different kinds of the decorative panels in order to couple the decorative panel between the supporting members 21 by sliding the decorative panel to the sliding slots 211 through the top openings thereof. Therefore, the decorative panel will be retained between the supporting members 21 and spacedly overlapped with the supporting panel 22. The user is also able to detachably attach the decorative sleeves 32 at the supporting members 21 respectively to enhance the decorative effect of the furniture. Once the decorative elements 31 and the decorative sleeves 32 are attached to the main supporting frame 20, the user is able to place the utilizing unit 10 back to the original position. Throughout the decorative process, the user does not need to disassemble the main supporting frame 20, such as detaching the supporting panel 22 from the supporting members 21 or detaching the supporting members 21 from the base 24. The user is able to change the decorative elements 31 and/or the decorative sleeves 32 from the main supporting frame 20 by removing the decorative elements 31 and/or the decorative sleeves 32 from the main supporting frame 20 and re-attaching other decorative elements 31 and/or other decorative sleeves 32 to the main supporting frame 20. Therefore, no disassembling process is required for the main supporting frame 20 to interchange the decorative elements 31 and/or the decorative sleeves 32.

Figure 5:
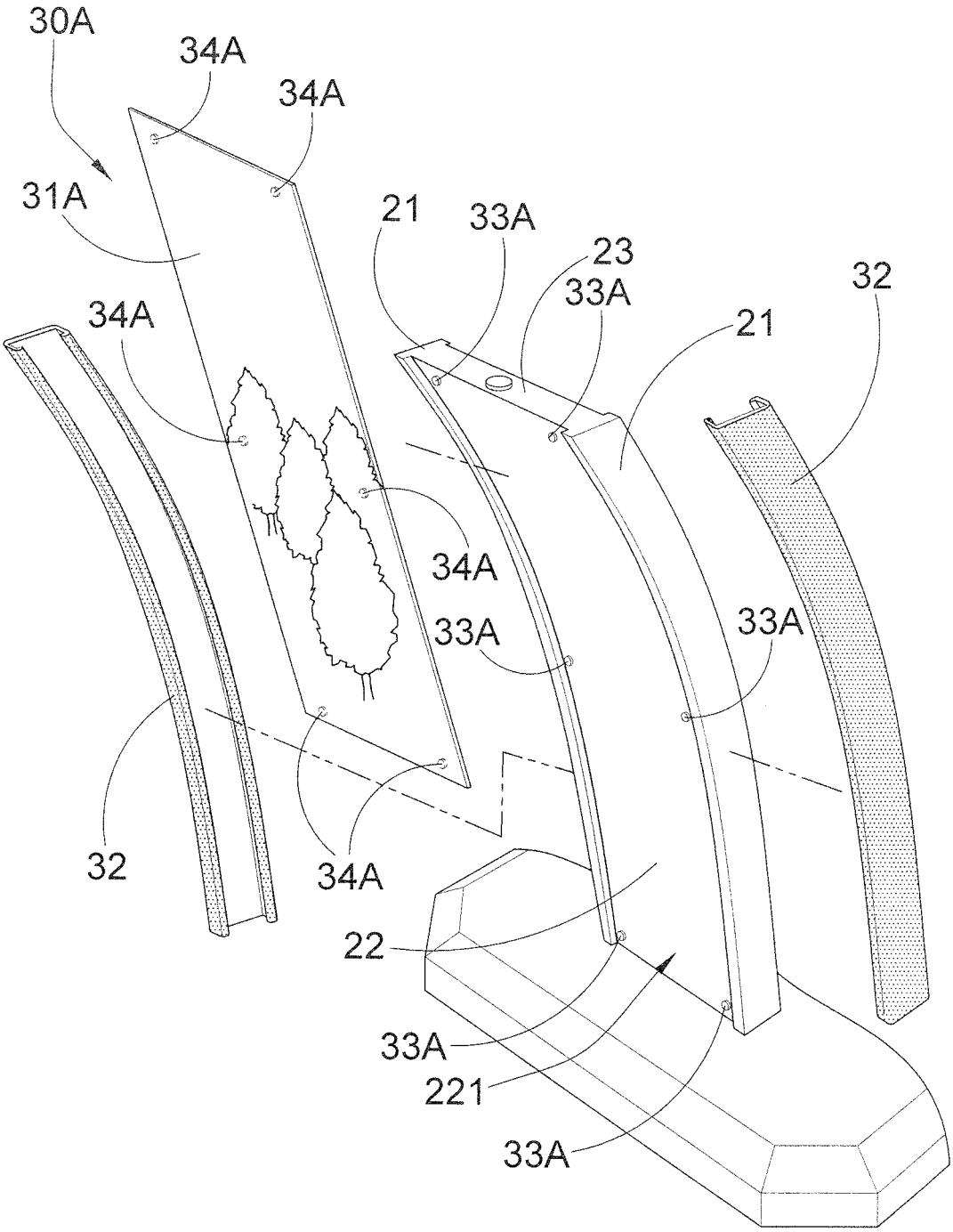
FIG. 5 illustrates a first alternative mode of the interchangeable arrangement according to the above second preferred embodiment of the present invention.

FIG. 5 illustrates a first alternative mode of the interchangeable arrangement 30A, wherein the decorative elements 31A are detachably attached on the decorative faces 221 of the supporting panels 22 respectively by magnetic engagement. Accordingly, the interchangeable arrangement 30A further comprises a plurality of first magnetic elements 33A spacedly formed at the decorative face 221 of each of the supporting panels 22, and a plurality of second magnetic elements 34A spacedly formed at each of the decorative panels, such that the first and second magnetic elements 33A, 34A are magnetically attracted with each other to detachably overlap the decorative elements 31A on the decorative faces 221 of the supporting panels 22 respectively. Preferably, the first magnetic elements 33A are spacedly formed at the decorative face 221 of each of the supporting panels 22 at a peripheral portion thereof. The second magnetic elements 34A are spacedly formed at each of the decorative panels at a peripheral portion thereof. Therefore, each of the decorative elements 31A is encircled within the two supporting members 21, the base 24, and the top support 23.

Figure 6:
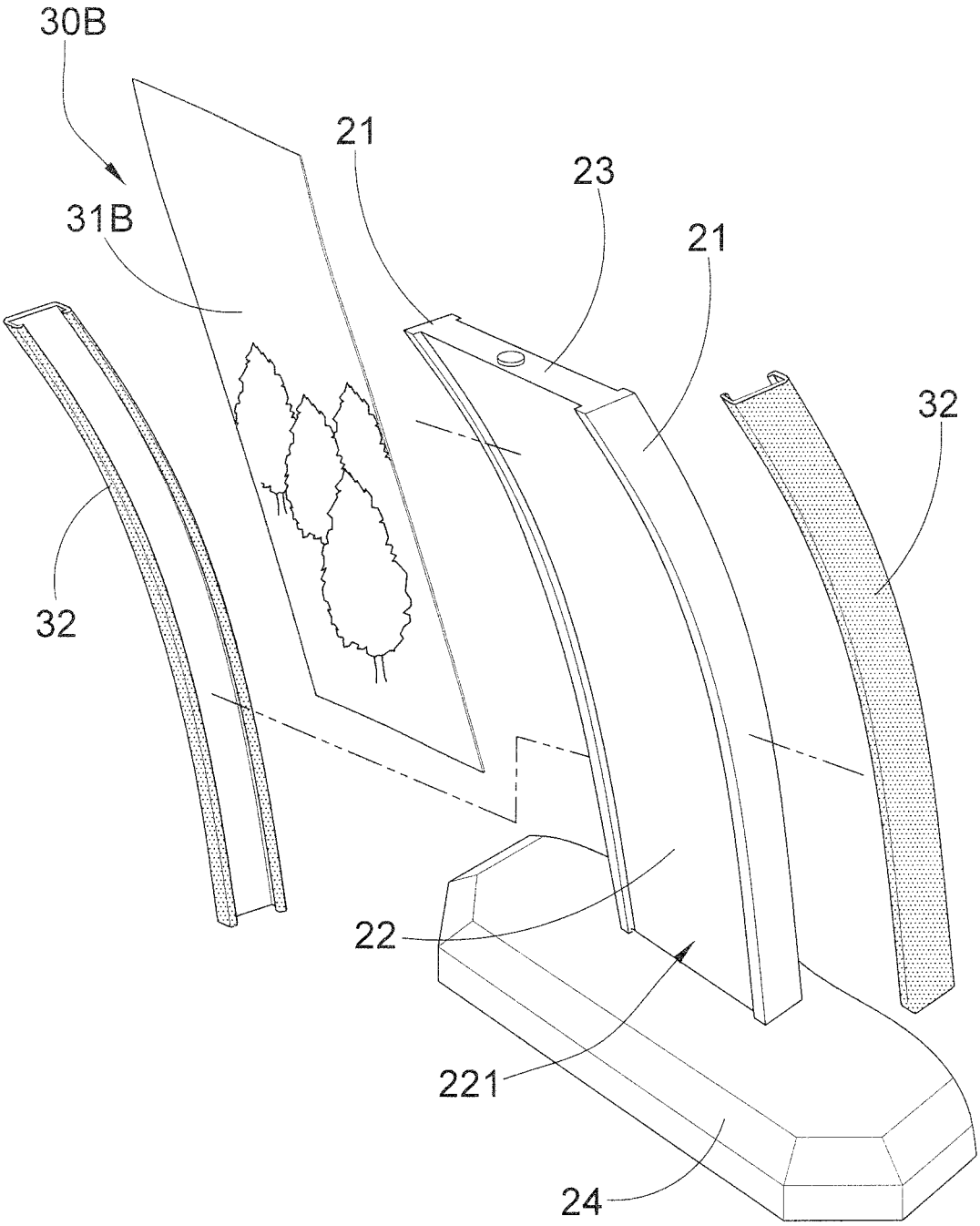
FIG. 6 illustrates a second alternative mode of the interchangeable arrangement according to the above second preferred embodiment of the present invention.

FIG. 6 illustrates a second alternative mode of the interchangeable arrangement 30B, wherein the decorative elements 31B are detachably attached on the decorative faces 221 of the supporting panels 22 respectively by means of static cling. Accordingly, each of the decorative elements 31B are made from a thin plastic film that clings to the decorative face 221 of the supporting panel 22 with static electricity. Each of the decorative elements 31B is free of adhesive and is easily to be removed, repositioned and reused.

Figure 7:
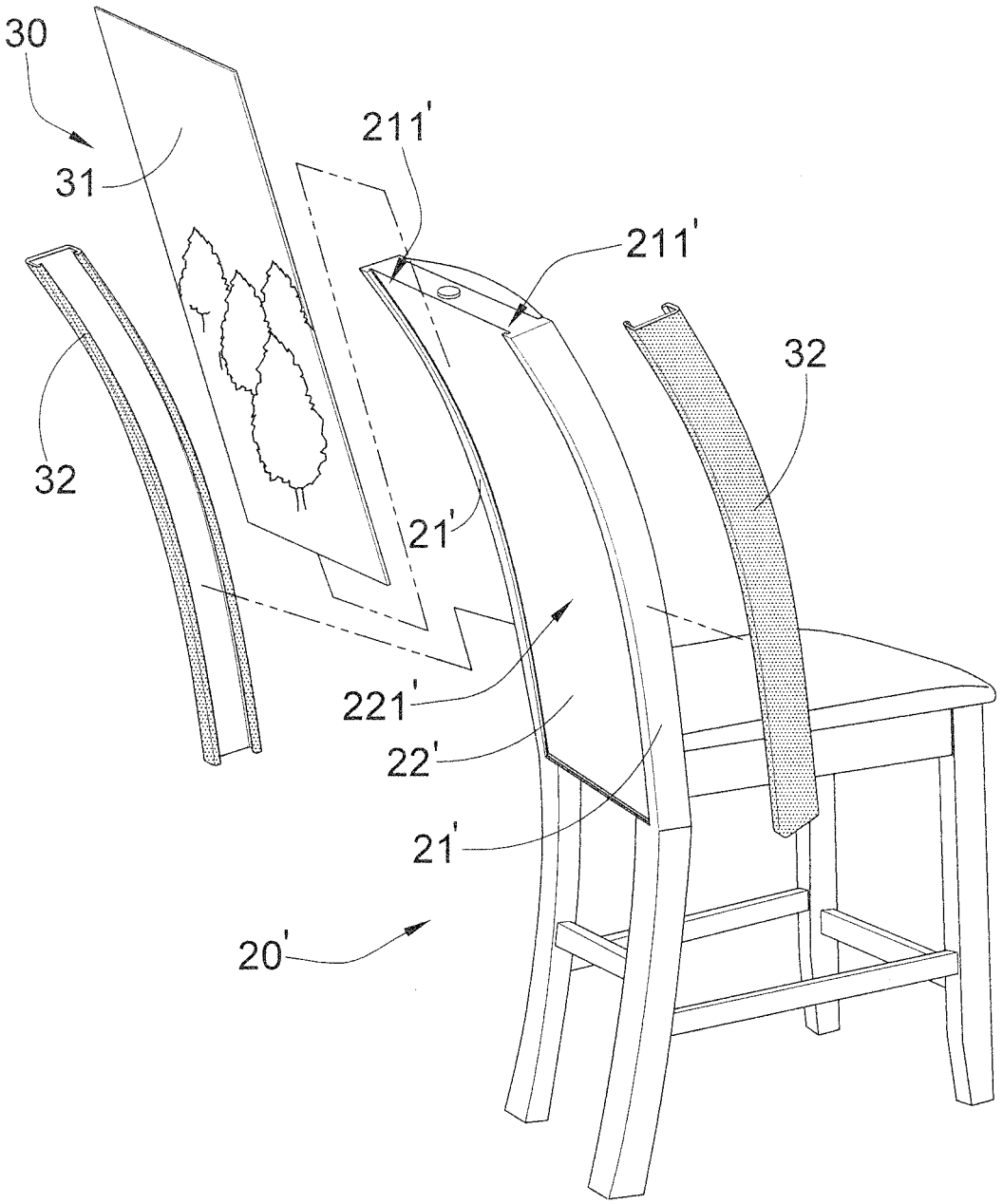
FIG. 7 illustrates the interchangeable arrangement incorporating with the chair according to the above second preferred embodiment of the present invention.

FIG. 7 illustrates the interchangeable arrangement 30 incorporating with the chair. As it is mentioned above, the utilizing unit 10' is a sitting panel and the main supporting frame 20' is a leg frame and/or back supporting frame. The interchangeable arrangement 30 is incorporated with the back supporting frame of the chair in order to change an overall ornamental design of the chair without disassembling the main supporting frame 20'.

As shown in FIG. 7, the two supporting members 21' form two side frames of the back supporting frame of the chair, wherein the supporting panel 22' is extended between the two supporting members 21'. Accordingly, the two sliding slots 211' are formed at the inner sides of the supporting members 21' and are facing toward each other. Therefore, the decorative panel 31 is detachably coupled between the supporting member 21' when two side edge portions of the decorative panel 31 are slidably engaged with the sliding slots 211', so as to overlap the decorative panel 31 with the decorative face 221' of the supporting panel 22'. The decorative sleeves 32 can also detachably enclose the supporting members 21' respectively. Preferably, the decorative panel 31 is overlapped with a rear side of the supporting panel 22'. It should be appreciated that the decorative panel 31 can be detachably overlapped on the supporting panel 22' of the back supporting frame of the chair by magnetic engagement or by means of static cling. As a result, the decorative effect of the chair will match with the table to form a table set. In other words, the user is able to change an overall ornamental design of the table set by interchanging the decorative panels 31 and/or the decorative sleeve 32 to table and chair.

The outer surface of the frame cover has various kinds of designs such that the frame cover provides decorative functions to the supporting frame. In other words, not only the decorative element can provide ornament function, but also the supporting frame can provide decorative function via the frame cover thereon.

It is worth mentioning that the decorative panels 31 and the decorative sleeve 32 not only enhance the aesthetic appearance of the furniture but also protect the furniture from scratching. The decorative panels 31 and the decorative sleeve 32 can be made of waterproof or fire proof material to prolong the life span of the furniture.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A furniture, comprising:

a utilizing unit;

a main supporting frame supporting said utilizing unit, wherein said main supporting frame comprises a plurality of supporting members formed in pair to support said utilizing unit and a plurality of supporting panels, wherein each of said supporting panels is coupled between each pair of said supporting member to form a H-shaped cross sectional configuration, wherein a decorative face is formed on said supporting panel; and an interchangeable arrangement which comprises a plurality of reusable decorative elements interchangeably and selectively coupled at said decorative faces of said main supporting frame respectively to change an overall ornamental design of the furniture without disassembling said main supporting frame, wherein said decorative elements are detachably overlapped at said decorative faces of said supporting panels respectively.

2. The furniture, as recited in claim 1, wherein each pair of said supporting members has two sliding slots formed at inner sides thereof and formed in front of said supporting panel, wherein each of said decorative elements is slid at said sliding slots to couple between said two supporting members and to overlap on said decorative face of said respective supporting panel.

3. The furniture, as recited in claim 2, wherein each of said decorative elements is a decorative panel that two side edge portions of said decorative panel are slidably engaged with said sliding slots to couple said decorative panel between said two supporting members and to position in front of said supporting panel.

4. The furniture, as recited in claim 3, wherein each pair of said supporting members are parallel with each other and are extended in a curve configuration that each pair of said supporting members are curve d outwardly from said utilizing unit such that upper ends of said supporting members form an enlarged supporting area to support said tabletop, wherein said decorative panel is made of flexible material to match with a curvature of said supporting member when said decorative panel is slidably engaged between said sliding slots.

5. The furniture, as recited in claim 4, wherein said main supporting frame further comprises a plurality of top supports, wherein each of said top supports is extended between two top ends of said pair of said supporting members, wherein a top opening of each of said sliding slots is formed at said top end of said supporting member at a position adjacent to said top support, wherein said top openings of said sliding slots are exposed for interchanging said decorative element when said utilizing unit is detached from said main supporting frame.

6. The furniture, as recited in claim 5, wherein said main supporting frame further comprises a base that said supporting members are upwardly extended from said base, wherein a bottom opening of each of said sliding slots is blocked by said base, such that said decorative element is slid to engage with said sliding slots and is blocked by said base.

7. The furniture, as recited in claim 6, wherein said interchangeable arrangement further comprises a plurality of decorative sleeves detachably enclosing said supporting members respectively, wherein said decorative sleeves are made of flexible material, wherein said sliding slots are exposed when said supporting members are received in said decorative sleeves respectively.

8. The furniture, as recited in claim 2, wherein said main supporting frame further comprises a plurality of top supports, wherein each of said top supports is extended between two top ends of said pair of said supporting members, wherein a top opening of each of said sliding slots is formed at said top end of said supporting member at a position adjacent to said top support, wherein said top openings of said sliding slots are exposed for interchanging said decorative element when said utilizing unit is detached from said main supporting frame.

9. The furniture, as recited in claim 8, wherein said main supporting frame further comprises a base that said supporting members are upwardly extended from said base, wherein a bottom opening of each of said sliding slots is blocked by said base, such that said decorative element is slid to engage with said sliding slots and is blocked by said base.

10. The furniture, as recited in claim 2, wherein said interchangeable arrangement further comprises a plurality of decorative sleeves detachably enclosing said supporting members respectively, wherein said decorative sleeves are made of flexible material, wherein said sliding slots are exposed when said supporting members are received in said decorative sleeves respectively.

11. The furniture, as recited in claim 1, wherein said interchangeable arrangement further comprises a plurality of first magnetic elements spacedly formed at said decorative face of each of said supporting panels, and a plurality of second magnetic element spacedly formed at each of said decorative elements, wherein said decorative elements are detachably attached on said decorative faces of said supporting panels respectively by magnetic engagement.

12. The furniture, as recited in claim 1, wherein each of said decorative elements is made of thin plastic film that clings to said decorative face of said supporting panel with static electricity, such that said decorative elements are detachably attached on said decorative faces of said supporting panels respectively by means of static cling.

13. A table, comprising:

a tabletop;

a leg frame which comprises a plurality of supporting members formed in pair to support said tabletop, and a plurality of supporting panels, wherein each of said supporting panels is coupled between each pair of said supporting member to form a H-shaped cross sectional configuration, wherein a decorative face is formed on said supporting panel; and an interchangeable arrangement which comprises a plurality of decorative panels, wherein each of said decorative panels is coupled between each pair of said supporting members on said decorative face of said supporting panel to enhance an overall ornamental design of the table without disassembling said leg frame, wherein said decorative panels are detachably overlapped at said decorative faces of said supporting panels respectively.

14. The table, as recited in claim 13, wherein each pair of said supporting members are parallel with each other and are extended in a curve configuration that each pair of said supporting members are curved outwardly to said tabletop, wherein said decorative panel is made of flexible material to match with a curvature of said supporting member when said decorative panel is coupled on said decorative face of said supporting panel, such that upper ends of said supporting members form an enlarged supporting area to support said tabletop.

15. The table, as recited in claim 14, wherein each pair of said supporting members has two sliding slots formed at inner sides thereof and formed in front of said supporting panel, wherein each of said decorative panels is slid at said sliding slots to couple between said two supporting members and to overlap on said decorative face of said respective supporting panel, wherein top openings of said sliding slots are exposed for interchanging said decorative panel when said tabletop is detached from said leg frame.

16. The table, as recited in claim 15, wherein said interchangeable arrangement further comprises a plurality of decorative sleeves detachably enclosing said supporting members respectively, wherein said decorative sleeves are made of flexible material, wherein said sliding slots are exposed when said supporting members are received in said decorative sleeves respectively.

17. The table, as recited in claim 14, wherein said interchangeable arrangement further comprises a plurality of first magnetic elements spacedly formed at said decorative face of each of said supporting panels, and a plurality of second magnetic element spacedly formed at each of said decorative panels, wherein said decorative panels are detachably attached on said decorative faces of said supporting panels respectively by magnetic engagement.

18. The table, as recited in claim 14, wherein each of said decorative elements is made of thin plastic film that clings to said decorative face of said supporting panel with static electricity, such that said decorative panels are detachably attached on said decorative faces of said supporting panels respectively by means of static cling.

* * * * *